US006362794B1

(12) United States Patent
Yu

(10) Patent No.: US 6,362,794 B1
(45) Date of Patent: Mar. 26, 2002

(54) ANTENNA OF WIRELESS LAN CARD

(75) Inventor: Tom Yu, Hsin Chu Hsien (TW)

(73) Assignee: GemTek Technology Co., Ltd., Hu Kou Hsiang (TW)

( * ) Notice: Subject to any disclaimer, the term of this patent is extended or adjusted under 35 U.S.C. 154(b) by 0 days.

(21) Appl. No.: 09/910,923

(22) Filed: Jul. 24, 2001

(51) Int. Cl.[7] ..... H01Q 1/24
(52) U.S. Cl. ..... 343/702; 343/882
(58) Field of Search ..... 343/702, 715, 343/878, 880, 882, 900; 455/89, 90; H01Q 1/24

(56) References Cited

U.S. PATENT DOCUMENTS 4,136,344 A * 1/1979 Nakao et al. ..... 343/702
5,422,651 A * 6/1995 Chang ..... 343/749
5,644,320 A * 7/1997 Rossi ..... 343/702
5,828,341 A * 10/1998 Delamater ..... 343/702
6,215,445 B1 * 4/2001 Chang ..... 343/702
6,292,146 B1 * 9/2001 Melax ..... 343/702
6,300,911 B1 * 10/2001 Murray et al. ..... 343/702

* cited by examiner

*Primary Examiner*—Tho G. Phan
(74) *Attorney, Agent, or Firm*—Jacobson Holman, PLLC

(57) ABSTRACT

An antenna of the wireless LAN card includes a body with an antenna on one side, a connecting base is on one side of the external wireless LAN card, a pivot pin is on top of the connecting base; a cross pivot wraps the pivot pin. The cross pivot composes of a tube with a pintle on both sides. A ball tip is on the bottom of the antenna, a hole is inside the ball tip, a joint hole each is on both sides of the hole. The two pintles of the cross pivot are inserted into the joint hole of the ball tip of the antenna. The structure makes the direction of the antenna of the wireless LAN card adjustable for best signal transmission and receiving result.

4 Claims, 4 Drawing Sheets

ANTENNA OF WIRELESS LAN CARD

BACKGROUND OF THE INVENTION

I. Field of the Invention

This invention relates generally to an antenna of the wireless LAN (Local Area Network) card that makes the direction of the antenna on the wireless LAN card adjustable for the best signal transmission and receiving condition.

II. Description of the Prior Art

Heretofore, it is known the computer network in the office environment has to be linked together with wires, such arrangement not only increases the hardware expense but also costs money to decorate the office to hide the wire.

Most of the desktop computers are very bulky, the case body and monitor of a computer occupy most of the desk area, and the working area left is small. The simplest way to solve the bulky computer problem is to replace the desktop computer with a notebook computer. However the notebook computers still have to use wires to connect to the network, the wiring hassle mentioned above still exists. A better way to solve the problem is to use an external wireless LAN card connected to the notebook computers; the wireless LAN card has an antenna externally, therefore the whole network can be connected together wirelessly.

The antenna of the known wireless LAN cards are fixed on the cards, most of them have directional characteristic, therefore when a wireless LAN is installed to a notebook computer, the direction of antenna might be placed in a location of the user's favorite spot. If the direction of antenna is not matched properly, data transmission and receiving might not be so smooth, and might not transmit or receive at all.

SUMMARY OF THE INVENTION

It is therefore a primary object of the invention to provide an antenna of the wireless LAN card that makes the direction of the antenna of the wireless LAN card adjustable for best signal transmission and receiving result.

In order to achieve the objective set forth, an antenna of the wireless LAN card in accordance with the present invention comprises a body with an antenna on one side; a connecting base is on one side of the external wireless LAN card, a pivot pin is on the top of the connecting base; a cross pivot wraps the pivot pin. The cross pivot composes of a tube with a pintle on both sides. A ball tip is on the bottom of the antenna, a hole is inside the ball tip, a joint hole is on both sides of the hole. The two pintles of the cross pivot are inserted into the joint hole of the ball tip of the antenna.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
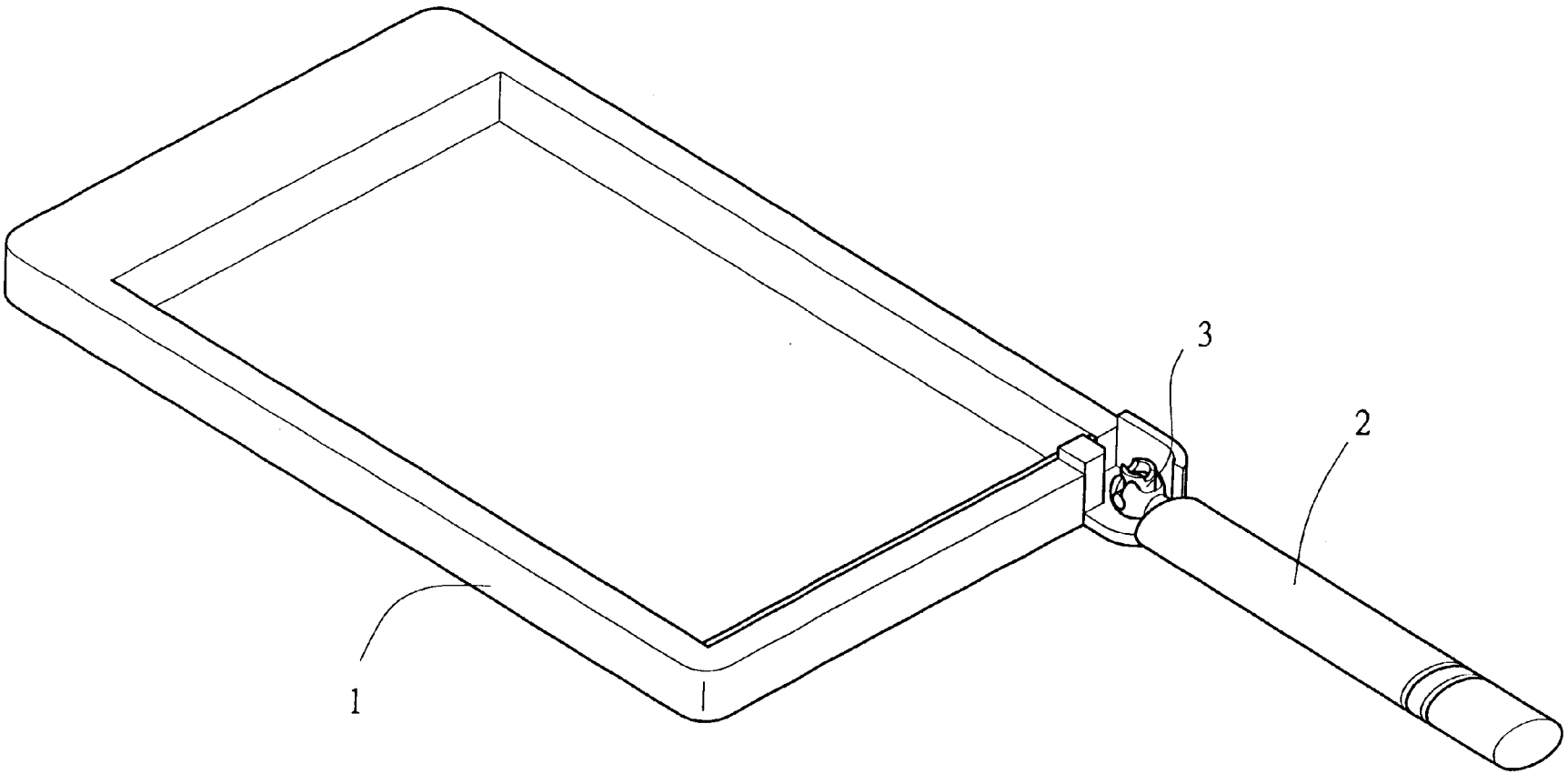
FIG. 1 is a perspective view of the present invention.
Figure 2:
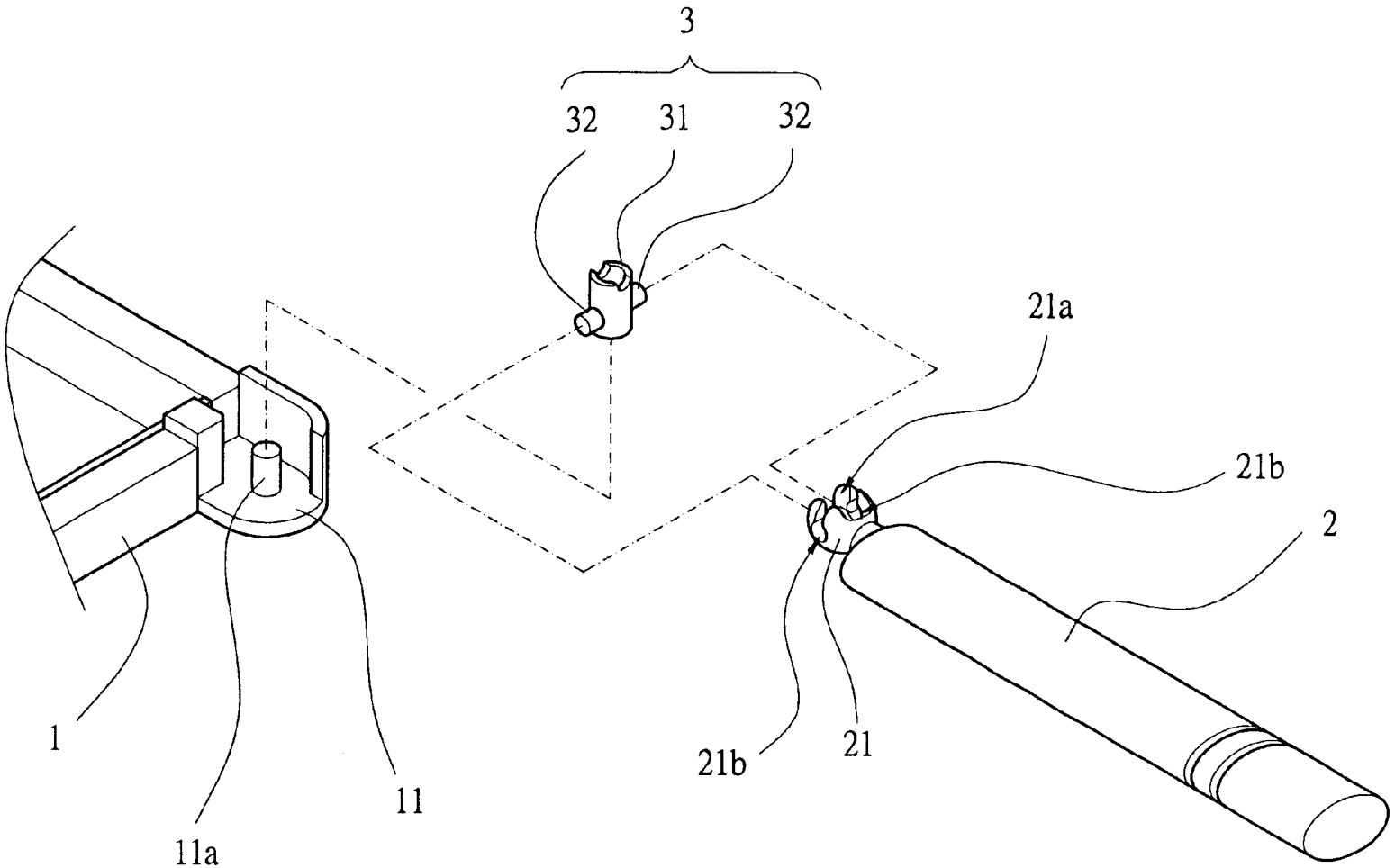
FIG. 2 is a cross-sectional view of the present invention.

Referring to FIG. 1 and FIG. 2, the present invention is composed of a body 1 with an antenna 2 on one side. A connecting base 11 is on one side of the body 1, a pivot pin 11*a* is on the top of the connecting base 11; a cross pivot 3 wraps the pivot pin 11*a*. The cross pivot composes of a tube 31 with a pintle 32 on both sides. A ball tip 21 is on the bottom of the antenna 2, a hole 21*a* is inside the ball tip 21, a joint hole 21*b* is on both sides of the hole 21*a*. The two pintle 32 of the cross pivot 3 are inserted into the joint hole 21*b* of the ball tip 21 of the antenna 2, such structure can fix the antenna 2 to the body 1.

Figure 3:
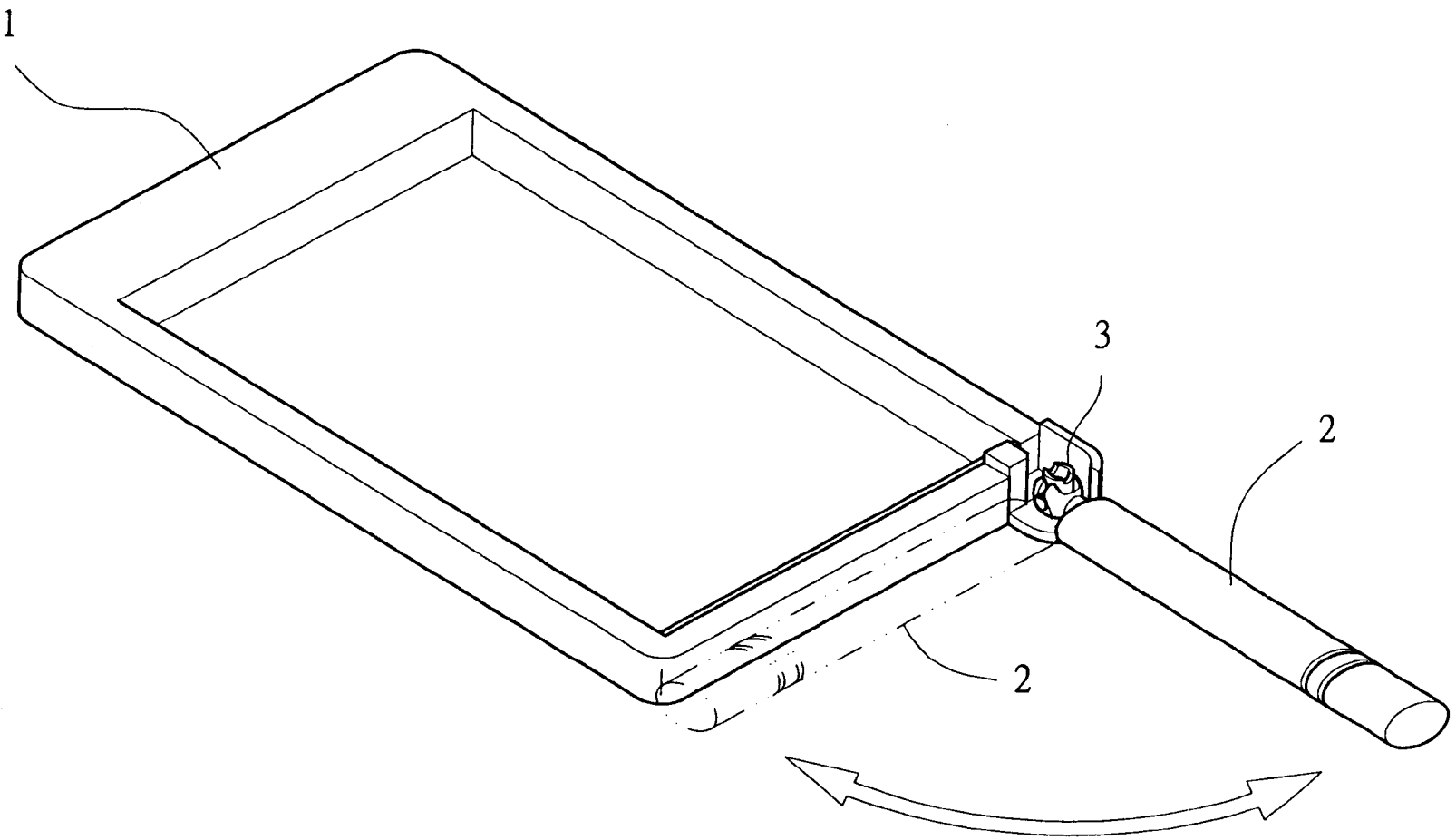
FIG. 3 is a perspective view of the present invention while the antenna rotates horizontally.
Figure 4:
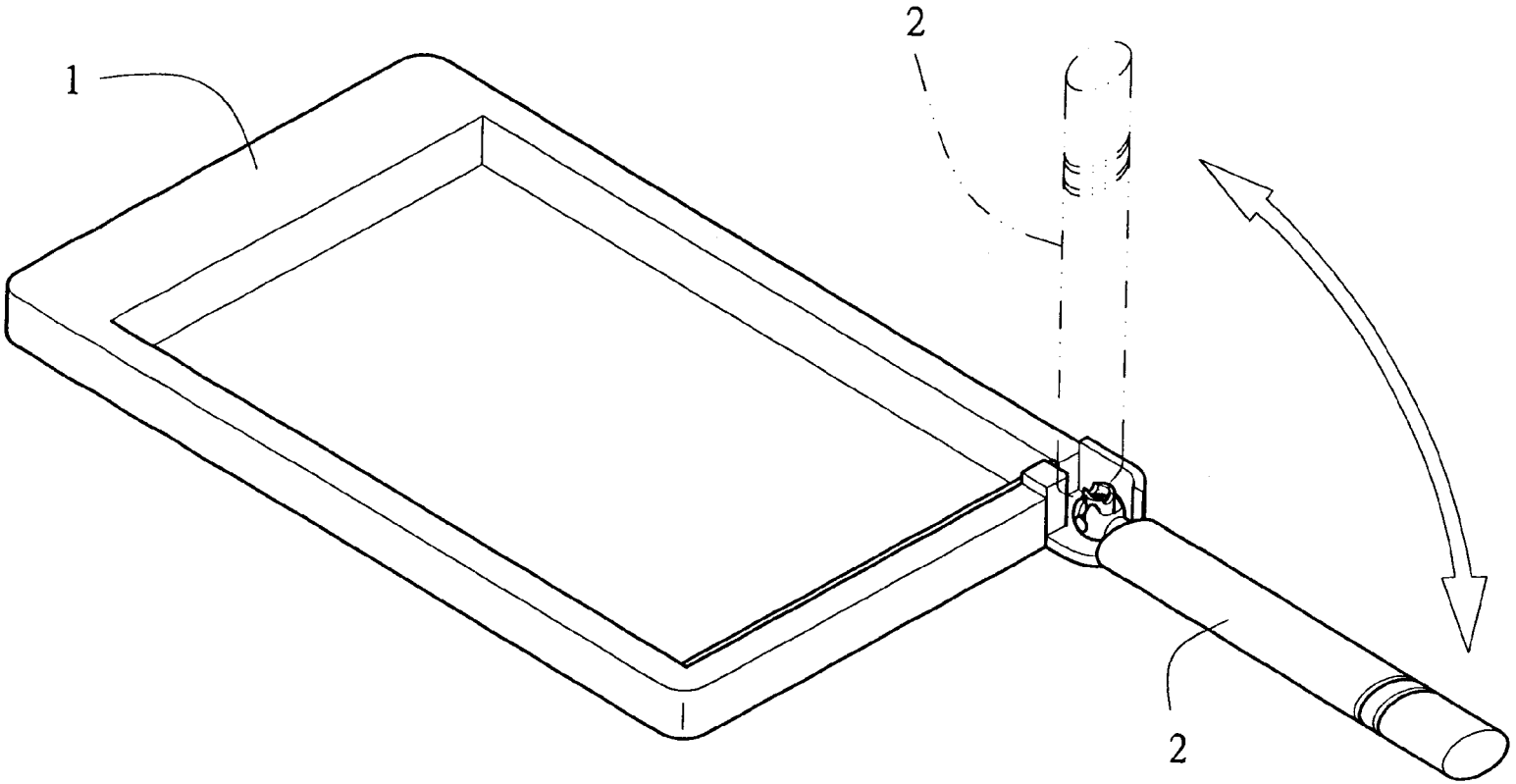
FIG. 4 is a perspective view of the present invention while the antenna rotates vertically.

Based on above description, the antenna 2 attaches to the cross pivot 3 through ball tip 21. The cross pivot 3 wraps on the pivot pin 11*a* of the connecting base 11 of the wireless LAN card. Such arrangement makes the antenna 2 rotate horizontally, as shown in FIG. 3. The antenna 2 is attached on the cross pivot 3, therefore it also can turn vertically, as shown in FIG. 4. The antenna 2 can be adjusted to the proper position for signal transmission and receiving to avoid data error condition.

The body 1 can be a PCMCIA or a CF interface LAN card.

The body 1 can be a radio receiver or a radio transmitter, for example, radio, cellular phone, cordless phone, remote control transmitter or receiver . . . with the same improving result.

While a preferred embodiment of the invention has been shown and described in detail, it will be readily understood and appreciated that numerous omissions, changes and additions may be made without departing from the spirit and scope of the invention.

What is claimed is:

1. An antenna of a wireless LAN card comprising:

a body with an antenna on one side;

a connecting base located on one side of said body;

a pivot pin on top of said connecting base;

a cross pivot covering said pivot pin, said cross pivot composes of a tube with a pintle on both sides;

a ball tip on the bottom of said antenna;

a hole being inside said ball tip;

a joint hole each on both sides of said hole, two said pintles of said cross pivot are inserted into said joint hole of said ball tip of said antenna.

2. The antenna of the wireless LAN card recited in claim 1, wherein said body is a PCMCIA or a CF interface LAN card.

3. The antenna of the wireless LAN card recited in claim 1, wherein said body is a radio receiver.

4. The antenna of the wireless, LAN card recited in claim 1, wherein said body is a radio transmitter.

* * * * *